US005879178A

United States Patent [19]

Koumatsu et al.

[11] Patent Number: 5,879,178

[45] Date of Patent: Mar. 9, 1999

[54] WATERPROOF CONNECTOR HOUSING

[75] Inventors: Seiji Koumatsu; Motohisa Kashiyama; Sakai Yagi, all of Shizuoka, Japan

[73] Assignee: Yazaki Corporation, Tokyo, Japan

[21] Appl. No.: 565,817

[22] Filed: Dec. 1, 1995

[30] Foreign Application Priority Data

Dec. 20, 1994 [JP] Japan ..... 6-316425

[51] Int. Cl.[6] ..... H01R 13/52

[52] U.S. Cl. ..... 439/271

[58] Field of Search ..... 439/271, 274–278, 439/89

[56] References Cited

U.S. PATENT DOCUMENTS

| | | | |
|---|---|---|---|
| 4,512,619 | 4/1985 | Dechelette | 439/276 |
| 4,556,226 | 12/1985 | Ito | 439/273 |
| 4,682,832 | 7/1987 | Punako et al. | 439/278 |
| 4,698,027 | 10/1987 | Vandame | 439/271 |
| 4,755,152 | 7/1988 | Elliot et al. | 439/276 |
| 4,859,200 | 8/1989 | McIntosh et al. | 439/275 |
| 4,917,620 | 4/1990 | Samejima et al. | 439/271 |
| 5,108,303 | 4/1992 | Maeda et al. | 439/271 |

FOREIGN PATENT DOCUMENTS

| | | | |
|---|---|---|---|
| 63-221568 | 9/1988 | Japan | H01R 13/52 |
| 3-219578 | 9/1991 | Japan | H01R 43/24 |

*Primary Examiner*—Neil Abrams
*Assistant Examiner*—Brian J. Biggi
*Attorney, Agent, or Firm*—Sughrue, Mion, Zinn, Macpeak & Seas, PLLC

[57] ABSTRACT

In a waterproof connector housing in which a hood portion for fitting with a counter housing is projected from a housing body portion, an elastic seal ring which maintains water-tightness with the counter housing is disposed inside the hood portion, and a retaining piece of the elastic seal ring is engaged with the hood portion, a fitting convex portion is projected integrally from an inner face of the hood portion on a contact face in which the hood inner face is contacted with the seal ring, and the elastic seal ring is integrally formed in a state where the fitting convex portion bites the seal ring.

7 Claims, 4 Drawing Sheets

FIG. 4a
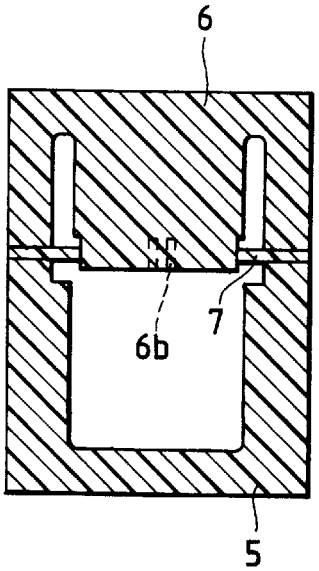
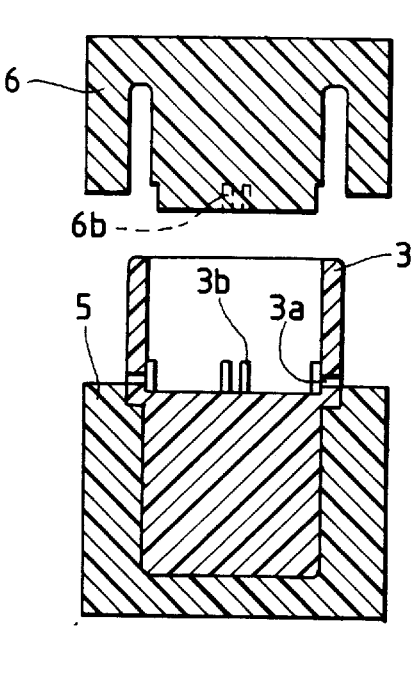
FIG. 4b
FIG. 4c
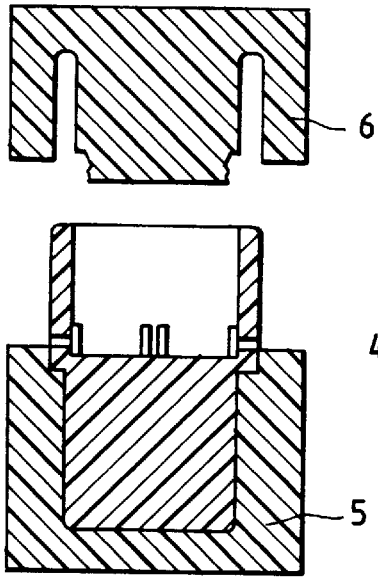
FIG. 4d
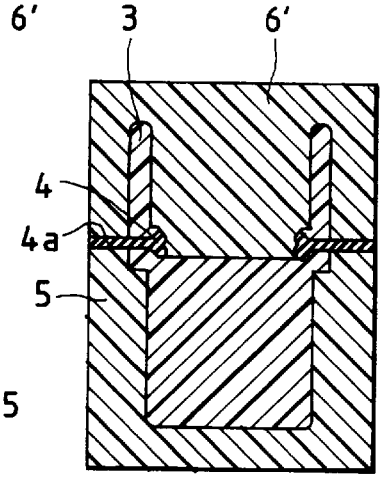
FIG. 4e
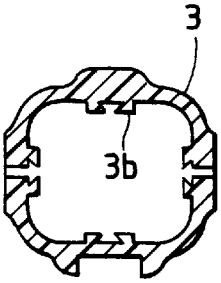
FIG. 4f
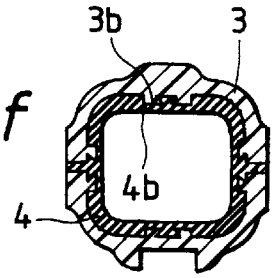

WATERPROOF CONNECTOR HOUSING

BACKGROUND OF THE INVENTION

1. Field of the Invention

This invention relates to a connector housing in which an elastic seal ring for maintaining watertightness with a counter connector housing is disposed inside a hood portion used for engagement with the counter connector housing.

2. Background

A method of producing a conventional connector housing of this type is described in Japanese patent publication No. Hei. 3-219578.

FIG. 7A shows a housing A which is produced by the above-mentioned method. The housing A comprises a hood portion 3 and an elastic seal ring 4. The hood portion 3 is expandedly formed via a step $\mathbf{2}_1$ of a housing body portion 1 so as to receive a counter connector housing. The elastic seal ring 4 is integrally disposed in a basal end portion of the hood portion 3, i.e., between the first step $\mathbf{2}_1$ and a second step $\mathbf{2}_2$. The elastic seal ring 4 comprises retaining pieces 4*a*. The retaining pieces 4*a* are respectively engaged in a tight manner with through holes 3*a* which are formed in the hood 3 in a direction perpendicular to a fitting axis of the housing. In the figure, 1*a* designates terminal accommodating chambers disposed inside the housing body 1.

The waterproof connector housing A is produced in the following manner, according to the publication. The housing body portion 1 and the hood portion 3 are molded in a primary molding step, and the elastic seal ring 4 is formed in a secondary molding step. In the primary molding step, upper and lower molds which are not shown are clamped together in an axial direction of the housing A to be molded, so that the connector housing is formed by injection molding in accordance with a conventional method. In this molding process, a slide mold which slides in a direction perpendicular to the axial direction is disposed between the upper and lower molds. Passageways 3*a* are formed for introducing an elastic material from the slide mold to a portion in which the seal ring is to be formed inside the hood portion 3. The passageways 3*a* function also as engagement holes for the retaining pieces 4*a*.

FIG. 7B shows the state of the secondary molding. An upper mold 6' having a vacant space 8 corresponding to the portion in which the elastic seal ring is to be formed, and the lower mold 5 which holds the housing body portion 1 are clamped together. Then, a liquid elastic material is introduced into the portion (the vacant space 8) in which the seal ring is to be formed, from a gate 9*a* of a runner 9 disposed in the slide mold 7 via the passageways 3*a* of the hood portion 3.

In the primary molding step, ridges (not shown) protruding in the axial direction are formed at the first and second steps $\mathbf{2}_1$ and $\mathbf{2}_2$ in the housing A. Similar ridges are formed over a total length of the outer periphery of each passageway 3*a*. These ridges are pressed and crushed when the upper mold 6' abuts against the slide mold 7 during the clamping, so that these molds come in tight contact with each other. As a result, it is possible to prevent the liquid elastic material having good fluidity from leaking.

FIG. 8 is a section view taken along a plane which is perpendicular to the axial direction of the housing A and includes the passageways 3*a* (the terminal accommodating chambers are not illustrated). The housing body 1 is engaged with the seal ring 4 made of the elastic material by only the retaining pieces 4*a* and the engagement holes 3*a*. The housing portion and the seal ring are integrally formed as described above, but the materials thereof are different from each other. When the housing is to be fitted with a counter connector housing, therefore, a portion of the seal ring 4 other than the vicinity of the engagement portion may be stripped off so as to produces problems such as the engagement operation becomes difficult to do, and that sufficient watertightness cannot be attained.

In the housing A, it may be considered that such stripping can be suppressed by increasing the number of engagement points between the retaining pieces 4*a* and the engagement holes 3*a*. Since the engagement holes 3*a* are formed by the slide mold as described above, however, such a countermeasure results in an increase of the production cost of molds and hence an increase of the cost of the product.

Japanese patent publication No. Hei. 3-219578 describes also a connector housing B shown in FIG. 9. The housing B comprises retaining pieces 4*a*' and engagement holes 3*a*' which are disposed in a step $\mathbf{2}_1$'. In the housing B, engagement points exist in the step $\mathbf{2}_1$'. When the housing is to be fitted with a counter connector housing, therefore, a leading portion Q of a seal ring 4' is easily stripped off. That is, the housing B involves the same problems as those of the housing A.

SUMMARY OF THE INVENTION

The present invention has been conducted in view of the problems associated with the above-mentioned conventional example. It is an object of the invention to provide a waterproof connector housing comprising an elastic seal ring which is not stripped off during the operation of fitting the connector housing with a counter connector housing and hence exhibits good watertightness without increasing the production cost.

In order to solve the above-mentioned problems, according to a first aspect of the present invention, there is provided a waterproof connector housing in which a hood portion for fitting with a counter housing is projected from a housing body portion, an elastic seal ring for maintaining watertightness with the counter housing is disposed in the hood portion, and a retaining piece of the elastic seal ring is engaged with the hood portion, wherein a fitting convex portion is projected integrally from a hood inner face on a contact face in which the hood inner face is contacted with the seal ring, and the elastic seal ring is integrally formed in a state where the fitting convex portion bites the seal ring.

The fitting convex portion desirably has a dovetail groove shape (a groove substantially having a reversed triangular shape in section), i.e., a shape of the so-called dovetail joint, because such a shape prevents the fitting from being broken.

Further, according to a second aspect of the present invention, there is provided a waterproof connector housing in which a hood portion for fitting with a counter housing is projected from a housing body portion, an elastic seal ring for maintaining watertightness with the counter housing is disposed in the hood portion, and a retaining piece of the elastic seal ring is engaged with the hood portion, wherein a fitting convex portion is projected integrally from a hood bottom face on a contact face in which the hood bottom face is contacted with the seal ring, and the elastic seal ring is integrally formed in a state where the fitting convex portion bites the seal ring.

In this case, the fitting convex portion may have a shape of a rectangular parallelepiped or a circular cylinder which protrudes as a column from the hood bottom face, or one of various shapes such as cones, pyramids, and truncated cones and pyramids. In the view point of the function for preventing the seal ring from being stripped off, the fitting convex portion may preferably have a rectangular parallelepiped shape.

In the waterproof connector housing of the invention, the fitting convex portions are protrudently disposed so as to be integrated with the hood portion on the contact face of the hood inner face with the seal ring, or with the hood bottom face of the waterproof connector on the contact face of the hood bottom face with the seal ring, and the elastic seal ring is integrally formed in a state where the fitting convex portions bite or enter the seal ring. Accordingly, the seal ring will not be stripped off during the operation of fitting the connector housing with a counter connector housing. In addition, the case will not occur where the seal ring is pulled by a mold and left in the mold.

BRIEF DESCRIPTION OF THE DRAWINGS

FIGS. 4*a* to 4*f* are views illustrating a method of producing the embodiment of the waterproof connector housing according to the first aspect of the present invention:

FIG. 4*a* shows a first step,

FIG. 4*b* shows a second step,

FIG. 4*c* shows a third step,

FIG. 4*d* shows a fourth step,

FIG. 4*e* is a section view taken along a mold contact face of the connector housing in the second step (the terminal accommodating chambers are not illustrated), and FIG. 4*f* is a section view taken along a mold contact face of the connector housing in the fourth step (the terminal accommodating chambers are not illustrated);

DETAILED DESCRIPTION OF THE PREFERRED EMBODIMENTS

Figure 1:
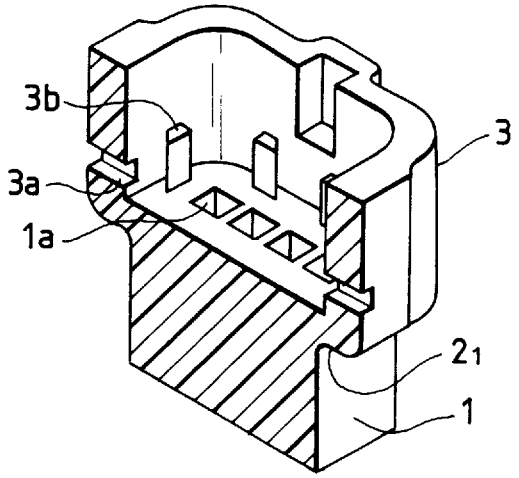
FIG. 1 is a perspective section view of a first embodiment of the waterproof connector housing according to a first aspect of the present invention in which an elastic seal ring is not illustrated.
Figure 2:
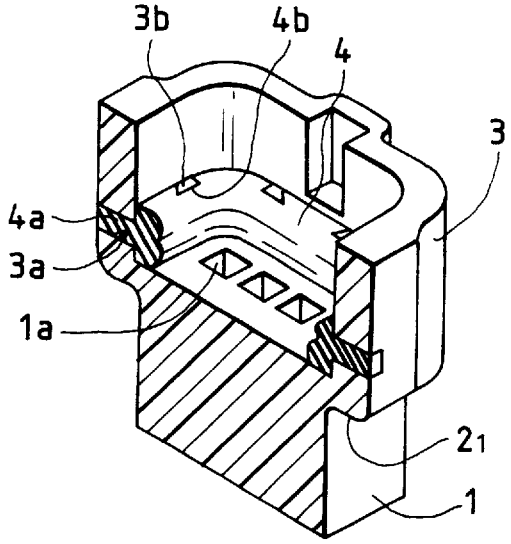
FIG. 2 is a perspective section view of the embodiment of the waterproof connector housing according to the first aspect of the present invention in which the elastic seal ring is illustrated.

FIG. 1 is a perspective section view showing a first embodiment of the waterproof connector housing according to a first aspect of the invention in which an elastic seal ring has not yet been formed. FIG. 2 is a perspective section view showing the sate where the elastic seal ring has been formed. In the figures, 1 designates a housing body portion, and 3 designates a hood portion projected from the housing body portion 1 via a step $\mathbf{2}_1$. The hood portion 3 is used for fitting with a counter housing. An elastic seal ring 4 for maintaining watertightness with the counter housing is disposed in the hood portion 3. Retaining pieces 4*a* of the elastic seal ring are engaged with respective engagement holes 3*a* of the hood portion 3, so as to prevent the elastic seal ring 4 from being slipped off.

The hood portion 3 comprises fitting convex portions 3*b* which have a dovetail groove shape and are projected from an inner face of the hood portion which contacts the elastic seal ring 4. The seal ring 4 is formed in a state where the fitting convex portions 3*b* bite or enter respective fitting concave portions 4*b*. In the figures, 1*a* designates terminal accommodating chambers disposed inside the housing body 1.

Figure 3:
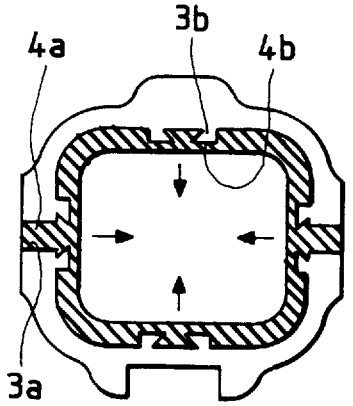
FIG. 3 is a view of the embodiment of the waterproof connector housing according to the first aspect of the present invention which is seen from a hood portion in an axial direction (terminal accommodating chambers are not illustrated)

Referring to FIG. 3, forces applied to the seal ring when the waterproof connector housing is fitted with the counter connector housing will be described. FIG. 3 is a view of the waterproof connector housing according to the first aspect of the invention which is seen from the hood portion in an axial direction (the terminal accommodating chambers are not illustrated). During the operation of fitting the connector housing with the counter connector housing, forces indicated by arrows in the figure are applied to the elastic seal ring. Since the elastic seal ring 4 is formed in the state where the fitting convex portions 3*b* of the dovetail groove shape bite or enter the fitting concave portions 4*b,* the elastic seal ring 4 can oppose the forces, so that it will not be stripped off. Accordingly the operation of fitting the connector housing with the counter connector housing is easily performed, and the watertightness as designed can be maintained.

The connector housing can be produced, for example, as shown in FIGS. 4*a* to 4*d*. FIGS. 4*a* to 4*d* are section views of molds used for molding the connector housing and intermediate products in respective steps. The production steps proceed in the order of the figures.

As shown in FIG. 4*a,* a cavity is first formed by clamping together an upper mold 6 for molding the connector housing and having grooves 6*b* for forming the fitting convex portions, a lower mold 5, and a slide mold 7 (first step).

Next, a resin is introduced into the cavity from a runner (not shown), so that the housing body portion and the hood portion are integrally formed (second step).

FIG. 4*e* is a section view taken along a mold separating face of the connector housing in this step (the terminal accommodating chambers are not illustrated). The hood portion 3 has engagement holes 3*a* formed by the slide mold 7. The hood portion 3 has also fitting convex portions 3*b* which are formed integrally with the inner face of the hood portion 3 by the fitting convex portion forming grooves 6*b* of the mold 6.

Thereafter, as shown in FIG. 4*c* the upper mold 6 is replaced with an upper mold 6 for molding an elastic seal ring, and the upper mold 6' and the lower mold 5 are clamped together (third step).

In a fourth step, as shown in FIG. 4*d,* a liquid silicone rubber is introduced from the engagement hole portions, thereby molding the elastic seal ring 4. FIG. 4*f* shows a section view taken along a mold separating face of the connector housing in this step (the terminal accommodating chambers are not illustrated). The figure shows that the elastic seal ring is integrally formed in such a manner that the fitting convex portions 3*b* bite or enter the fitting concave portions 4*b* and the retaining pieces 4*a* are engaged with the engagement holes 3*a* of the hood portion 3.

As a final step, runners connected to the retaining pieces 4*a* are cut off, thereby completing the production of the waterproof connector housing according to the invention.

Figure 5:
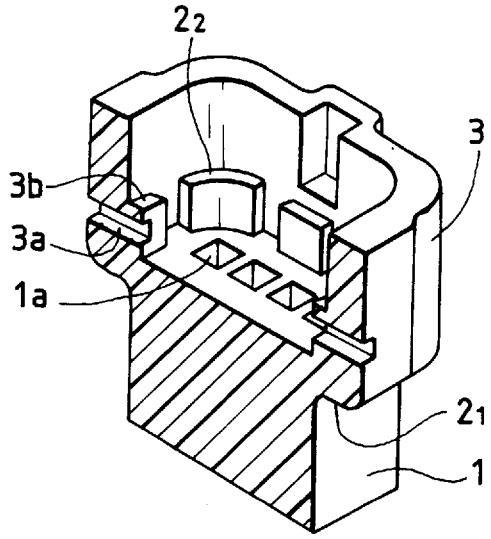
FIG. 5 is a perspective section view of another example of the first embodiment of the waterproof connector housing according to the first aspect of the present invention in which an elastic seal ring is not illustrated.

In the above, the embodiment in which the fitting convex portions 3*b* are so-called male dovetail grooves has been described. In the invention, for example, the fitting convex portion 3*b* may be a dovetail groove which is entirely formed protrudently (a so-called female dovetail groove) by disposing a step portion $\mathbf{2}_2$ on the hood inner face as shown in FIG. 5 (a perspective section view in a state where the elastic seal ring has not yet been formed). Also in the alternative, an elastic seal ring which is prevented from being stripped off can be formed by the same method as described above.

Figure 6:
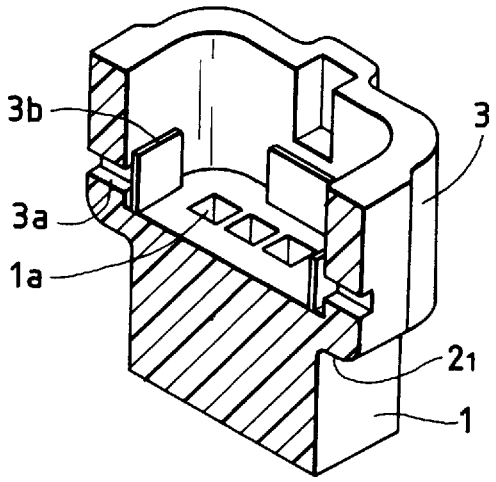
FIG. 6 is a perspective section view of a second embodiment of the waterproof connector housing according to a second aspect of the present invention in which an elastic seal ring is not illustrated.
Figure 7A:
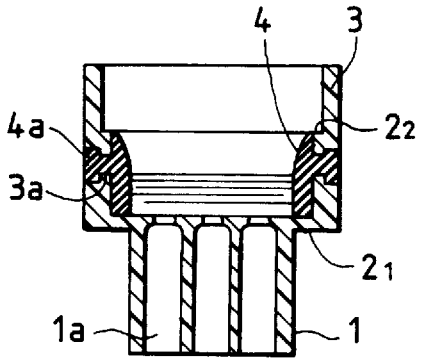
FIG. 7A is a section view of a waterproof connector housing A according to the conventional example.
Figure 8:
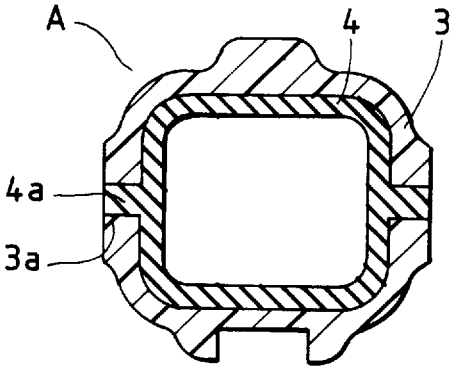
FIG. 8 is a section view of the waterproof connector housing A according to the conventional example taken along a plane which is perpendicular to the axial direction and includes passageways 3*a* (terminal accommodating chambers are not illustrated)
Figure 7B:
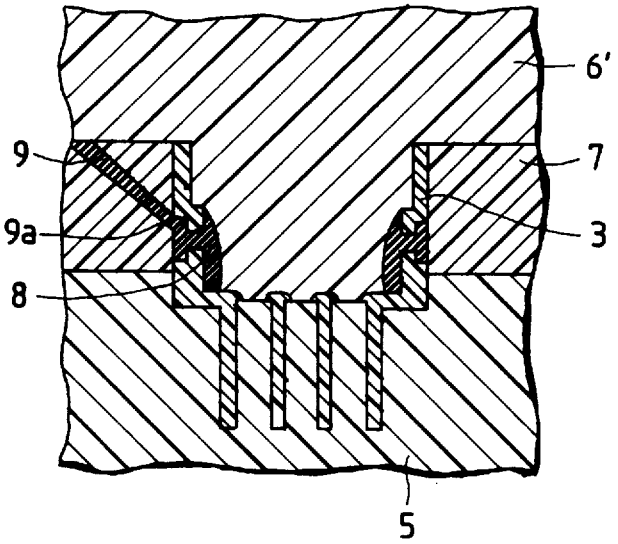
FIG. 7B is a section view of a connector and molds in a secondary molding of the waterproof connector housing A according to the conventional example.
Figure 9:
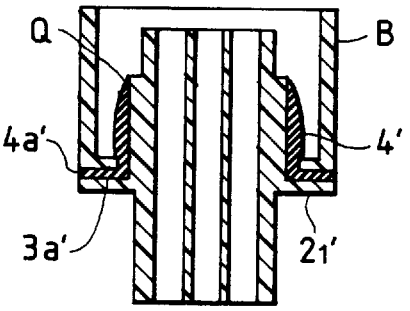
FIG. 9 is a section view of a waterproof connector housing B according to the conventional example.

FIG. 6 is a perspective section view showing a second embodiment of a waterproof connector housing according to a second aspect of the invention in a state where an elastic seal ring has not yet been formed.

The reference numeral 1 designates a housing body portion, and 3 designates a hood portion projected from the housing body portion 1 via a step 2. The hood portion 3 is used for fitting with a counter housing. An elastic seal ring 4 (not shown) for maintaining watertightness with the counter housing is disposed in the hood portion 3. The elastic seal ring comprises retaining pieces 4*a* (not shown) of a rectangular parallelepiped shape. Each retaining piece is engaged with an engagement hole 3*a* of the hood portion 3, so as to prevent the elastic seal ring 4 from being slipped off. Fitting convex portions 3*b* are protrudently disposed integrally with a hood bottom face on a contact face in which the bottom face of the hood 3 is contacted with the seal ring. The fitting convex portions 3*b* bite the seal ring, so that the seal ring will not be stripped off.

Also in the waterproof connector housing according to the second aspect of the invention, the seal ring is prevented from being stripped off, and hence the operation of fitting the connector housing with a counter connector housing can be easily performed, and the watertightness as designed can be maintained.

As described above, according to the invention, it is possible to obtain a waterproof connector housing in which there is no probability that the seal ring will be stripped off during the operation of fitting the connector housing with a counter connector housing and the watertightness is impaired, and which allows the fitting operation to be easily and smoothly performed, without increasing the production cost of the connector housing.

What is claimed is:

1. A connector, comprising:

a housing;

a hood portion for mating with a counter housing, said hood portion formed in said housing;

a seal ring for maintaining watertightness with the counter housing, disposed on an inside surface of said hood portion; and a fitting convex portion formed on said inside surface of said hood portion, said fitting convex portion biting said seal ring;

wherein said fitting convex portion projects from a bottom face of the hood portion which contacts said seal ring.

2. The connector of claim 1, wherein said fitting convex portion has a dovetail shape.

3. The connector of claim 1, wherein said fitting convex portion has a rectangular parallelepiped shape.

4. The connector of claim 1, wherein said fitting convex portion is integrally formed with said hood portion.

5. The connector of claim 1, wherein said fitting convex portion mates with a corresponding fitting concave portion in said seal ring.

6. The connector of claim 1 wherein said seal ring is disposed on the inside surface of said hood portion, said inside surface contacting a corresponding surface of said counter housing, such that said seal ring is disposed between said hood portion and said counter housing.

7. The connector of claim 1, wherein said fitting convex portion retains the seal ring in a direction perpendicular to an axial direction of the connector housing corresponding to a mating direction of the connector housing with the hood portion.

* * * * *